United States Patent [19]

Schriever

[11] 4,385,586

[45] May 31, 1983

[54] ESCAPE/RESCUE SYSTEM

[76] Inventor: Frederick G. Schriever, 64 Claireview, Grosse Pointe Shores, Mich. 48236

[21] Appl. No.: 299,560

[22] Filed: Sep. 4, 1981

[51] Int. Cl.[3] ..... E04H 6/42; G09G 3/06

[52] U.S. Cl. ..... 116/205; 52/174; 340/326; 340/407; 340/644

[58] Field of Search ..... 116/205; 52/174; 315/136; 340/286, 570, 593; 200/314; 250/462; 40/570

[56] References Cited

U.S. PATENT DOCUMENTS

| | | | |
|---|---|---|---|
| 259,544 | 6/1882 | Howard | 116/205 X |
| 1,944,276 | 1/1934 | Schepmoes | 40/570 |
| 2,085,807 | 7/1937 | Lindsey | 340/517 X |
| 2,169,657 | 8/1939 | Millson | 52/105 X |
| 2,480,584 | 8/1949 | Kohlhauer et al. | 250/462 X |
| 3,181,134 | 4/1965 | Le Saint et al. | 200/314 X |
| 3,336,456 | 8/1967 | Ploetz | 200/314 |
| 3,408,025 | 10/1968 | Davis | 116/205 |
| 3,591,941 | 7/1971 | Jaffe, Jr. | 40/570 |
| 3,663,781 | 5/1972 | Zimmerman et al. | 200/314 X |
| 3,665,626 | 5/1972 | Lund et al. | 40/570 |
| 4,208,983 | 6/1980 | Buckley | 116/205 |

FOREIGN PATENT DOCUMENTS

| | | | |
|---|---|---|---|
| 874554 | 6/1971 | Canada | 116/205 |

*Primary Examiner*—Daniel M. Yasich

*Attorney, Agent, or Firm*—Burton, Parker & Schramm

[57] ABSTRACT

An emergency evacuation path marking system employing a series of devices, each device having the tactile characteristics of shape and surface contacts, in combination, to indicate direction and distance to the nearest evacuation exit; the shape providing direction information and the surface contacts providing distance information. The devices also being capable of luminescence to aid in visual as well as tactile reference.

8 Claims, 10 Drawing Figures

ESCAPE/RESCUE SYSTEM

DESCRIPTION

1. Background of the Invention

This invention relates to an emergency evacuation guide system defining a tactile path serving to direct occupants of inhabited structures toward emergency exits when the interior of the structure is dark or smoke-filled to the point that occupants must rely on their sense of touch.

In the past, such emergency routes were marked with semi-continuous railings similar to that of U.S. Pat. No. 259,544 or with continuous, shaped strips of material as in U.S. Pat. No. 3,408,025. In the prior art the guidance system presented a surface that was rough to the touch as a person's fingers moved along the guide in a direction away from the escape area while movement toward the escape area presented the feeling of a smooth surface. No method or device has previously been devised which would impart tactually information regarding both direction and distance to the escape exit. The present invention seeks to fill this void.

2. Summary of the Invention

It is the object of this invention to provide a means for marking an evacuation route through a hotel/motel or the like which may become dark, smoke-filled, or otherwise undiscernible as to the nearest exit during such emergencies as fire or storm. In cases of sudden alarm, or in the event of smoke-producing emergencies, confusion and loss of direction are common. This invention is designed to provide an indication of direction and distance to the evacuation exit; direction and distance being provided without requirement for sight on the part of a person seeking such exit.

The invention comprises a series of individual devices, shaped generally in the form of an arrowhead with the small, generally pointed, end indicating the proper direction to proceed to the nearest evacuation exit. On the surface of each device is an ordered number of contacts, such number relating to the relative distance to the exit. The combination of shape and surface contacts, on devices being arranged in a row at an appropriate height above the floor, presents escape information which may be transmitted by the sense of touch to anyone walking, crawling or proceeding in a wheelchair. A person moving along a darkened hallway can feel the arrow shape and count the contacts by touch and know he is going in the right direction and has, say, three more doors to the exit.

DESCRIPTION OF THE PREFERRED EMBODIMENTS

Figure 1:
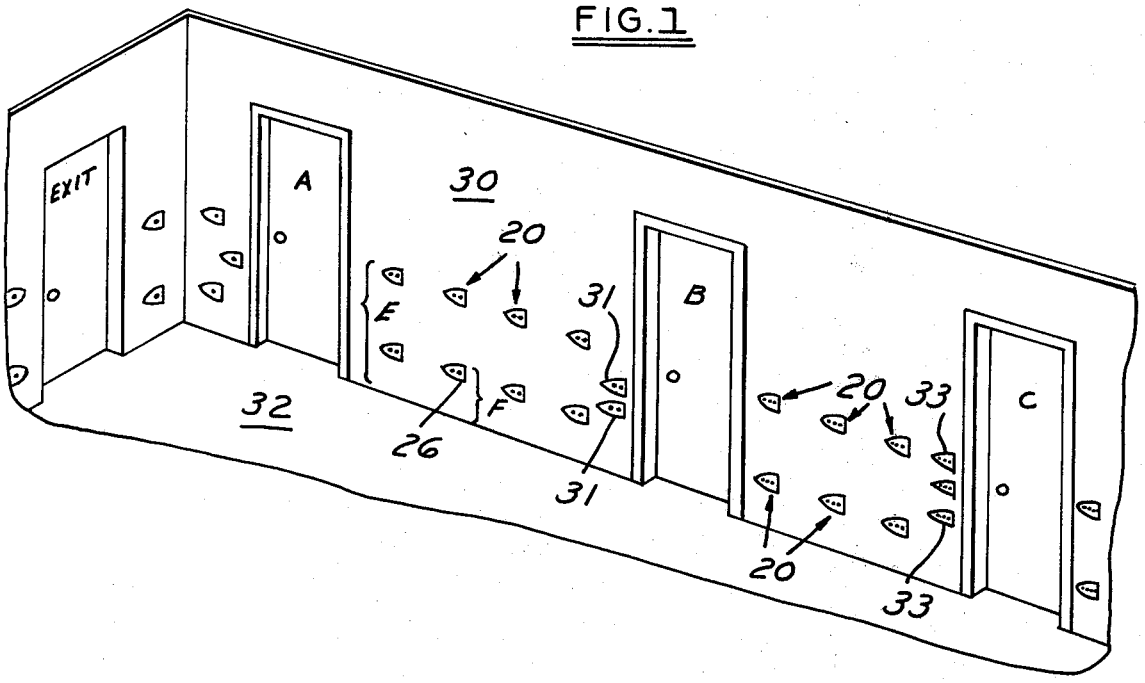
FIG. 1 provides a perspective view of a system of devices in the preferred arrangement on a hotel/motel corridor wall.
Figure 2:
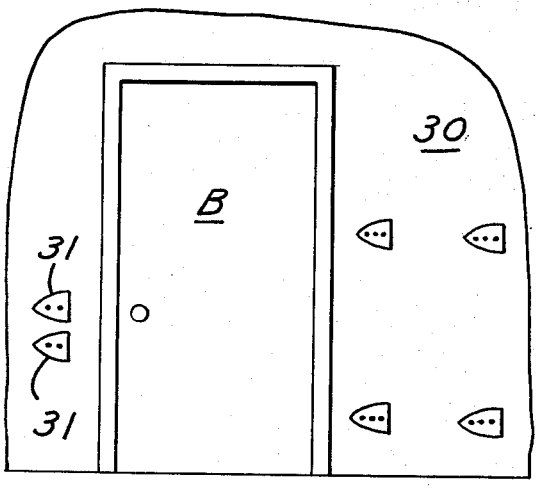
FIGS. 2 and 3 provide a partial view of two successive doors in a hotel/motel hallway with the novel devices placed to provide distance and direction information to a person in the hallway.
Figure 3:
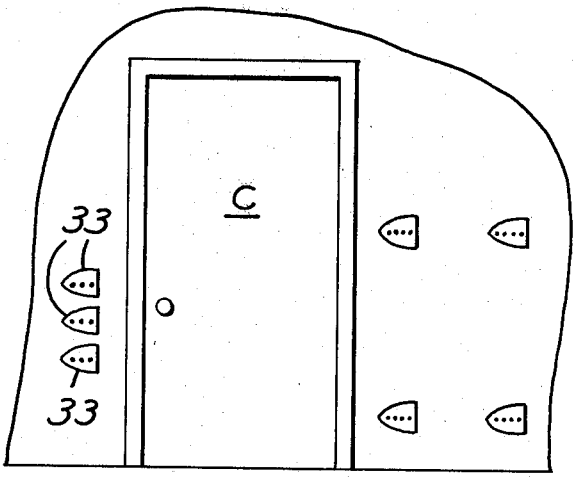

A preferred system for use of the invention is shown in FIGS. 1 through 5. Device 20, FIG. 4, used in the manner of similar devices shown in FIGS. 1 through 3, provides both direction and distance information to a person seeking a route to exit a hotel or motel corridor or hallway. The devices 20 are arranged in horizontal rows on the wall 30 at a height E convenient to a person walking or a height F convenient to a person crawling in the corridor. The general shape of the device indicates direction, the smaller end 21 pointing in the direction of the exit, while the surface of the device provides a tactile reference to a distance as will be explained.

Figure 4:
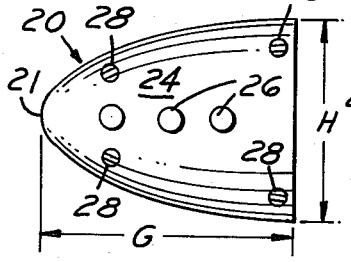
FIGS. 4 and 5 provide a top and end view, respectively, of the preferred device.
Figure 5:
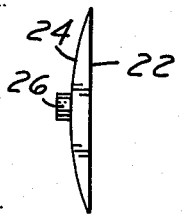
Figure 6:
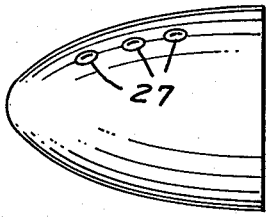
FIGS. 6 and 7 provide a top and end view, respectively, of an alternate arrangement of tactile contacts on the novel device.
Figure 7:
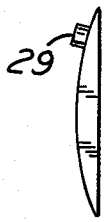

Device 20, FIGS. 4 and 5, is generally arrow-shaped, with longitudinal dimension G greater than lateral dimension H, both G and H being substantially greater than thickness J. A device constructed according to this embodiment will provide two major surfaces, the back 22 and the front 24. Back 22 is flat, to be in fixed contact with a similar flat surface, such as a wall, when the device is in place for its intended use. The front 24 is beveled or smoothly curved to eliminate sharp or protruding edges and may be provided with a contact point 26 of sufficient projection to be a tactile prominence. The device of FIG. 4, for purposes of illustration, shows three such contact points 26 in the form of protrusions. In FIG. 6, instead of protrusions, the contact points are depressions 27, three such being shown. They are disposed in a row above the centerline of the device. In FIG. 7 the protrusion 29 is above the centerline of the device. Whether protrusions 26 or 29 or depressions 27 are used, individual tactile contact points are positioned to be touched by a person running their hand along the wall 30. The number of such contact points depends on the distance of the device from the exit, as hereinafter explained. Device 20 is to be fixedly attached to wall 30 by any suitable means intended to be permanent; FIG. 4 shows the attachment to be by screw means 28. Although the attachment is shown by means of screws, other forms and means of attachment may occur to those skilled in the art.

Referring to FIGS. 1 through 3, a system for using device 20 is shown. A plurality of such devices constructed as described above are placed on corridor wall 30 in vertically spaced horizontal rows above floor 32, at heights convenient to the touch of a person walking or crawling, as previously described, with the devices pointing in the direction of the exit door shown in FIG. 1. Such devices will direct a person to proceed from the observer's right to left. The devices 31 on the left side of door A and devices 33 on the left side of door B at about the height of the door knob in FIGS. 2 and 3 also indicate the direction from right to left, and in addition by their number indicate the number of doors to the exit. Thus there are two devices 31 adjacent door A indicating there are two doors to the exit, while there are three devices 33 indicating three doors to the exit. In addition, each of the devices 20, 31 and 33 indicates the number of doors to the exit by the number of contact points 26, 27 or 29 on each device. Note that each device 20 and 31 between doors A and B, FIG. 1, has two contact points 26, indicating the exit to be two doors from that area of the corridor. A person proceeding in the direction from door B toward the exit, after passing door A, will find the devices now available to the touch have only one contact point, indicating one more door to the exit. The reduction in number of contact points on devices, as doors are passed, gives assurance that the person is proceeding toward the exit.

Devices 31 and 33 arranged in vertical arrays are placed on one side of each door, which side of the door is significant in that the exit is in that direction. As mentioned before, the number of devices in each such array indicates the number of doors to the exit. The reduction number of devices in each array, as doors are passed, again assures the person that the exit is being approached.

A person who has proceeded from the right or left on floor 32, and arrived in front of the exit door, FIG. 1, by touchingly perceiving direction and distance from the devices as described above, now has several indications available to confirm that such doorway is the exit. A tactile search of either side of the doorway will discover no array of devices, thus giving no indication of direction or further distance by an array means. However, a touching investigation of devices on both sides of the doorway will disclose that the direction-indicating shapes point toward each other, i.e., toward the exit; each device has only one contact point, i.e., one door to exit. In this manner the person can be assured they are at the exit.

Figure 8:
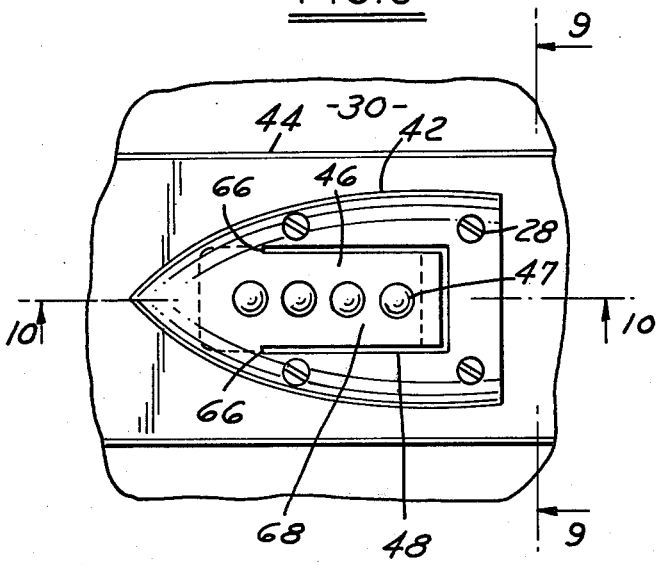
FIG. 8 is a frontal view of my novel device incorporating an illumination feature.
Figure 9:
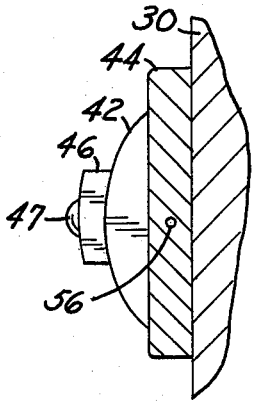
FIG. 9 is a cross-sectional view taken on the line 9—9 of FIG. 8.
Figure 10:
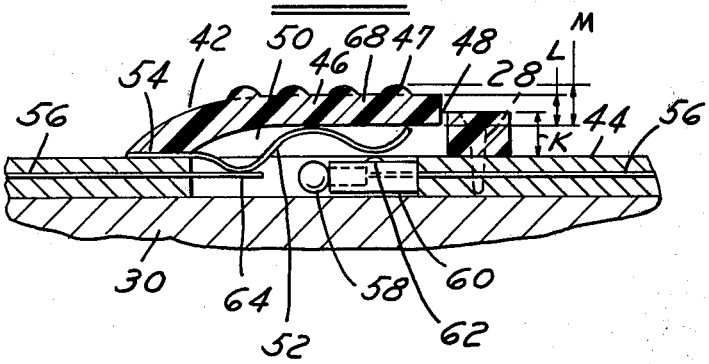
FIG. 10 is a cross-sectional view taken on the line 10—10 of FIG. 8.

Device 20, heretofore described, is for the purpose of providing a tactile means to guide a person along an emergency route within a structure when visual means is not available. FIGS. 8 through 10 depict this novel tactile device in combination with a means by which visual acuity may also be employed. Although a device might be of luminous material itself, device 42, FIG. 8 is constructed of a translucent, plastic-like material in the general arrow shape of basic device 20. The longitudinal and lateral dimensions of device 42 are of the same relative relationship as those of basic device 20, however, thickness K, FIG. 10, is greater than thickness J, FIG. 5, to accommodate a lighting means as will be described. Device 42 is mounted on wall 30 by screw means 28 and mounting strip 44.

Referring to FIGS. 8 through 10 in detail discloses that contact points 47 reside on tab 46, said tab being formed by a 3-sided cut 48 through the portion of device 42 which overlies a hollow area or cavity 50 within device 42. Cavity 50 is such that the general thickness L of tab 46 is less than the thickness M taken through said tab at a contact 47. The significance of the difference between thicknesses L and M will be explained.

Device 42 contains a spring-like metal member 52 fixedly attached to device 42 at 54 and extending longitudinally within cavity 50. Mounting strip 44 includes an electrical circuit consisting of wire 56, bulb 58 in socket 60, said socket having contact point 62, and a source of electrical power (not shown). The portion of tab 46 between ends 66 of cut 48 (FIG. 8), acts as a spring because of the resiliency of the material used in construction of device 42; the importance of this spring action will be discussed.

Device 42, FIG. 8, has all the capabilities for use in an escape system as described for device 20, FIG. 4. However, if the emergency presents only darkness as an obstruction to vision, a system employing device 42 instead of device 42 instead of device 20 will give another advantage to a person proceeding along floor 32 (FIG. 1). Specific reference to FIG. 10 shows that a person proceeding as above described, and using tactile means to receive the information available from the shape, surface contacts, and device placements previously mentioned, need only press each device 42 in the vicinity of area 68 on tab 46 to receive a visual aid. Finger pressure on tab 46 in the general area of 68 will cause said tab to depress. Depression of tab 46 will force metal spring 52 to contact electrical wire 56 at point 64 and socket contact point 62. When spring 52 contacts wire 56 and socket contact 62 as described, the electrical circuit is completed. Electricity flowing through the completed circuit causes bulb 58 to light and, because of the translucence of device 42, the device will appear to glow.

The glowing effect caused by the lighting of bulb 58 as described, provides visual confirmation of information previously gained by tactile means. Device 42 is one piece, FIG. 8, translucent material which allows passage of some light from bulb 58. Light passing through device 42 provides a view of the general arrow shape of said device and the shape thus imparts direction information to the viewer. The degree of translucence of the material is a function of the material thickness—thicker material passing less light. Hollow 50 of device 42, FIG. 10, is covered by tab 46 which has a general thickness L. A contact point, in this case protuberance 47, creates a different thickness M, and said protuberance will pass less light than the rest of tab 46. If the contact point were a concavity of tactile prominence, it would pass more light than tab 46. In either case, contact points of concavity or convexness will pass more or less light than does the surrounding tab. The shading effect, caused by light passing through the designed thickness variations between tab and contact point, provides a visual distinction that allows a person to see the contacts and, thus, gain information about distance to the exit. Release of finger pressure from area 68 will allow the resiliency of device 42, at point 66, to move tab 46 away from the electrical circuit. Movement of tab 46 from the electrical circuit will remove metal spring 52 from contact with wire 56 and bulb socket contact 62, thus opening the circuit and extinguishing bulb 58. In the above manner or using device 42, FIG. 8, a person seeking the exit from a hotel/motel corridor can move from door B to the exit, FIG. 1, by tactile reference only or by a combination of tactile and visual means.

I claim:

1. A system for tactually indicating both the direction of an escape route and the distance to an exit thereof for use in a building structure having a floor and wall along which a person will move in following the escape route, comprising, in combination:

a plurality of arrow-shaped members secured to the wall at determined spaced apart locations along the escape route in a position to be touched by the hand of a person moving along the floor adjacent the wall, said members being arranged with the smaller end pointing in the direction of the exit of the escape route; and each member having on an exposed surface, to be readily touched and counted by a person moving along the escape route, an ordered number of contact points wherein the number is related to the distance to such exit from each such member, whereby a person moving along the floor may tactually determine the direction to the exit and the distance at each such member.

2. The system defined in claim 1 wherein said members are arranged in a pair of horizontally extending vertically spaced apart rows at heights above the floor within the reach of a person walking or crawling.

3. The system defined in claim 2 wherein the arrangement of said members includes an array of devices at one side of a door, said array being on that side of the door in the direction of the exit and in such numbers to indicate the number of doors to the exit.

4. The system defined in claim 1 wherein the contact points are discrete protuberances discernible by touch.

5. The system defined by claim 1 wherein the contact points are discrete depressions.

6. The invention defined by claim 1 wherein the number of contact points on each member is related to the number of doors from such member to the exit.

7. The system defined by claim 1 wherein means are provided for reordering said members luminous.

8. The system defined by claim 7 wherein the luminosity is provided by means responsive to human touch for causing said members to be illuminated from an electrical source.

* * * * *

UNITED STATES PATENT OFFICE

CERTIFICATE OF CORRECTION

Patent No. 4,385,586 Dated May 31, 1983

Inventor(s) FREDERICK GEORGE SCHRIEVER

It is certified that error appears in the above-identified patent and that said Letters Patent are hereby corrected as shown below:

In Column 2, line 19, delete "a", second occurrence.

In Column 3, line 12, after "reduction" insert --- in ---.

In Column 3, line 67, delete "instead of device 42".

In claim 7, column 6, line 9, delete "reordering" and insert --- rendering --- .

Signed and Sealed this

Second Day of August 1983

[SEAL]

Attest:

GERALD J. MOSSINGHOFF

Attesting Officer

Commissioner of Patents and Trademarks